US009147964B2

(12) United States Patent
Kato et al.

(10) Patent No.: US 9,147,964 B2
(45) Date of Patent: Sep. 29, 2015

(54) CONNECTOR ASSEMBLY

(71) Applicant: YAZAKI CORPORATION, Minato-ku, Tokyo (JP)

(72) Inventors: Hajime Kato, Kakegawa (JP); Hiroshi Shinba, Ohta-ku (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/224,639

(22) Filed: Mar. 25, 2014

(65) Prior Publication Data

US 2014/0206213 A1 Jul. 24, 2014

Related U.S. Application Data

(63) Continuation of application No. PCT/JP2012/006151, filed on Sep. 26, 2012.

(30) Foreign Application Priority Data

Sep. 27, 2011 (JP) ..... 2011-210874

(51) Int. Cl.

| | |
|---|---|
| ***H01R 13/62*** | (2006.01) |
| ***H01R 13/533*** | (2006.01) |
| ***H01R 13/639*** | (2006.01) |
| *H01R 13/629* | (2006.01) |

(52) U.S. Cl.

CPC ..... *H01R 13/62* (2013.01); *H01R 13/533* (2013.01); *H01R 13/639* (2013.01); *H01R 13/62938* (2013.01); *H01R 2201/26* (2013.01)

(58) Field of Classification Search

CPC ..... H01R 13/6272; H01R 13/6275

See application file for complete search history.

(56) References Cited

U.S. PATENT DOCUMENTS

| | | | | |
|---|---|---|---|---|
| 4,938,710 | A | 7/1990 | Aihara et al. | |
| 5,203,718 | A | 4/1993 | Chishima | |
| 5,226,834 | A | 7/1993 | Kato et al. | |
| 5,911,599 | A | 6/1999 | Masuda | |
| 6,468,105 | B2 * | 10/2002 | Noguchi et al. | 439/489 |
| 6,544,066 | B2 * | 4/2003 | Fukase | 439/352 |
| 6,916,196 | B2 * | 7/2005 | Long et al. | 439/352 |
| 7,442,065 | B2 * | 10/2008 | Kuwayama | 439/352 |
| 7,806,715 | B2 * | 10/2010 | Zheng | 439/352 |
| 7,980,887 | B2 * | 7/2011 | Urano et al. | 439/489 |
| 2002/0182928 | A1 | 12/2002 | Matsushita | |

FOREIGN PATENT DOCUMENTS

| | | | |
|---|---|---|---|
| DE | 10 2009 048 481 | A1 | 4/2011 |
| JP | 08-330026 | A | 12/1996 |

OTHER PUBLICATIONS

International Search Report for PCT/JP2012/006151 dated Jan. 31, 2013.

* cited by examiner

*Primary Examiner* — Gary Paumen
(74) *Attorney, Agent, or Firm* — Sughrue Mion, PLLC

(57) ABSTRACT

A fixing bracket inserted into a cassette type insertion section of a male housing extends to the outside from an opening formed in a hood of a female housing under a state where the male connector is engaged with a female connector. A side face, a bottom face and a side face of the cassette type insertion section extending in the insertion direction of the male housing into the female housing come into face contact with inner faces provided for the hood, respectively.

2 Claims, 7 Drawing Sheets

CONNECTOR ASSEMBLY

CROSS REFERENCE TO RELATED APPLICATION

This is a continuation application based on PCT application No. PCT/JP2012/006151 filed on Sep. 26, 2012, which claims the benefit of priority from Japanese Patent Application No. 2011-210874 filed on Sep. 27, 2011, the entire contents of which are incorporated by reference herein.

BACKGROUND OF THE INVENTION

1. Field of the Invention

The present invention relates to a connector assembly that engages a second connector with a first connector by inserting a second housing of the second connector into a first housing of the first connector and connects a terminal of the second housing to a terminal in the first housing.

2. Description of the Related Art

There has conventionally been known a connector assembly that engages a second connector with a first connector by inserting a second housing of the second connector into a first housing of the first connector and that connects a terminal of the second housing to a terminal in the first housing. A connector assembly that, by inserting a housing of a male connector into a housing of a female connector, mutually connects terminals of both the housings is an outstanding example thereof.

This kind of connector assembly is used, for example, to connect various types of electric cables with each other inside a vehicle. Because electric cables are often routed within a confined space in a vehicle, various schemes are incorporated into the connector assembly to fix the connector assembly on the vehicle side in a narrow small space of the vehicle. As an example, there is a connector assembly that is fixed on a vehicle side by forming a cassette type insertion section on a side face of a housing of a female connector and/or a male connector and inserting an end of a bracket fixed on the vehicle side into the cassette type insertion section for clamping (for example, refer to FIG. 5 in Patent Literature 1: Japanese Patent Application Laid-Open Publication No. H08 (1996)-330026).

The connector assembly described above, in some cases, is formed with a high-voltage specification with recent widespread use of electric vehicles (EVs) and hybrid electric vehicles (HEVs). The connector assembly with such a specification has a tendency of being further upsized than a conventional connector assembly with a low voltage specification. Thus, the connector assembly tends to have large vibrations thereof when vehicle vibrations propagate through a bracket. Accordingly, in a large-sized connector assembly with a high voltage specification, such as a shield connector, it is preferable that both female and male connectors are tightly coupled to each other without any looseness under an engagement state thereof.

In this view, a conventional connector assembly which is lighter and smaller than a connector assembly with a high voltage specification has a sufficient coupling force in an engagement direction sufficiently ensured to completely connect terminals mutually. However, because of no necessity of such a force in each direction within a plane intersecting with the engagement direction, the connector assembly is not structured to obtain a sufficient coupling force with an engagement force between a female connector and a male connector. Accordingly, a connector assembly with a high voltage specification having a high tendency of being upsized may require a new structure to provide enhancement of a coupling force, which a conventional connector assembly has not adopted.

SUMMARY OF THE INVENTION

In view of the foregoing problems, the object of the present invention is to provide a connector assembly capable of achieving a sufficient coupling force between a first connector and a second connector in each direction within a plane intersecting with an engagement direction of the second connector with the first connector.

According to one embodiment of the present invention, there is provided a connector assembly including: a first connector with a first housing storing a first terminal thereof; and a second connector engaging with the first connector by inserting a second housing into the first housing such that a second terminal stored in the second housing is connected to the first terminal, wherein the second connector is mounted on a fixing bracket by inserting the fixing bracket into a cassette type insertion section formed on a side face of the second housing, the first housing has a hood allowing the cassette type insertion section to be inserted from an insertion direction of the second housing by inserting the second housing into the first housing, and under a state where the second connector is engaged with the first connector, an outer face of the cassette type insertion section extending in the insertion direction of the second housing into the first housing comes into face contact with an inner face provided for the hood, and the fixing bracket extends from an opening formed in the hood to the outside of the hood.

According to one embodiment of the present invention, with the second connector engaged with the first connector, the fixing bracket inserted into the cassette type insertion section of the second housing extends from the opening formed in the hood of the first housing to the outside. Thus, the cassette type insertion section has an opening for inserting the fixing bracket at an end face on the opposite side to the opening side of the hood in the insertion direction of the second housing into the first housing. Each of the outer faces of the cassette type insertion section extends in the insertion direction of the second housing into the first housing.

Accordingly, when the second connector is engaged with the first connector, a face contact portion with a fixed length in the insertion direction of the second housing into the first housing occurs between the hood of the first housing and the cassette type insertion section of the second housing. Thus, a tight and sufficient coupling force can be ensured without looseness between the first connector and the second connector in each direction within a plane intersecting with the insertion direction of the second housing into the first housing, in other words, each direction within a plane intersecting with the engagement direction of the second connector into the first connector.

According to one embodiment of the present invention, the hood has a pressure section therein for bringing into contact with the fixing bracket inserted into the cassette type insertion section in a state where the second connector is engaged with the first connector, thereby bringing the fixing bracket into pressure contact with an inner face of the cassette type insertion section.

According to one embodiment of the present invention, when the second connector is engaged with the first connector and the cassette type insertion section is inserted into the hood, looseness between the cassette type insertion section and the fixing bracket inserted thereinto is eliminated by a pressure contact of the fixing bracket with the inner face of the cassette type insertion section, which is generated by a pressure section. Thus, in each direction within a plane intersecting with the engagement direction of the second connector with the first connector, a tight and sufficient coupling force can be ensured without looseness between the cassette type insertion section and the fixing bracket.

According to one embodiment of the present invention, the connector assembly further includes a lever mounted on the first connector and structured to engage or disengage the second connector with or from the first connector by rotating the lever, wherein the cassette type insertion section is inserted into the hood as the second housing is inserted into the first housing by rotating the lever.

According to one embodiment of the present invention, the connector assembly that engages or disengages the second connector with or from the first connector by rotating the lever can tightly couple the first connector and the second connector in the engagement direction of the second connector with the first connector by rotating the lever. Thus, by inserting the cassette type insertion section of the second housing into the hood of the first housing by lever rotation, the first connector and the second connector can be tightly coupled in either direction within a plane intersecting with the engagement direction thereof.

The connector assembly according to the present invention provides a sufficient coupling force between a first connector and a second connector even in each direction within a plane intersecting with an engagement direction of the second connector with the first connector.

DESCRIPTION OF THE EMBODIMENTS

Figure 1A:
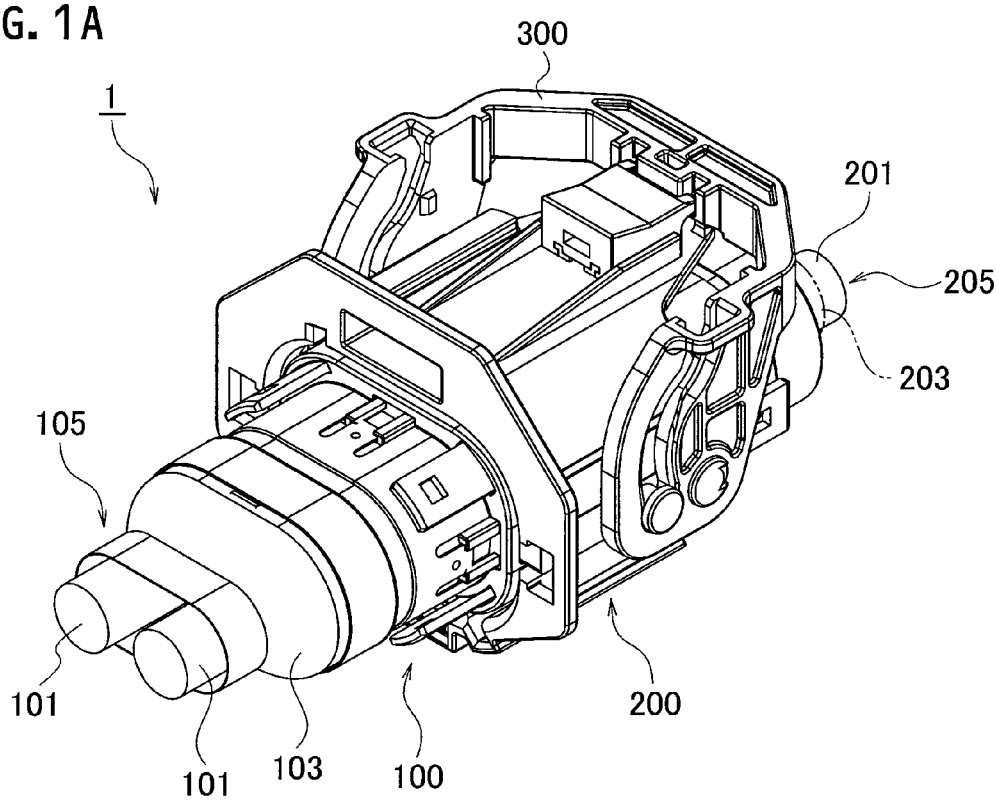
FIG. 1A is a perspective view of a shield connector according to an exemplary embodiment of the present invention viewed from a multi-core shield cable 105 side.

A connector assembly according to an exemplary embodiment of the present invention will be described below with reference to the accompanying drawings. Note that, in the present embodiment, a shield connector is described as one example of the connector assembly. In the description of the following drawings, the same or similar portions are designated by the same or similar reference characters. However, drawings are schematic and the proportion of each dimension is different from a real one.

Accordingly, detailed dimensions should be determined in consideration of the following descriptions. Moreover, there is a difference between relationships or percentages of dimensions in drawings.

Figure 1B:
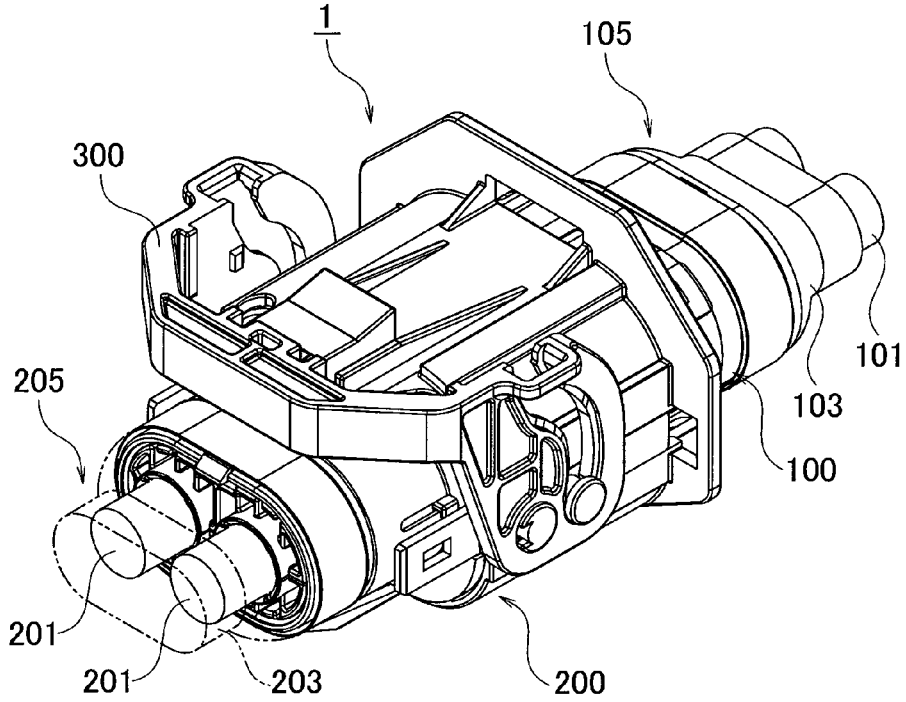
FIG. 1B is a perspective view of the shield connector according to the exemplary embodiment of the present invention viewed from a multi-core shield cable 205 side.

FIGS. 1A and 1B are perspective views of a shield connector according to the exemplary embodiment of the present invention. A shield connector 1 (connector assembly) shown in FIGS. 1A and 1B has a male connector 100 (second connector) and a female connector 200 (first connector) which are respectively fitted onto ends of multi-core shield cables 105 and 205. The shield connector constitutes a low insertion force connector (LIF connector). Thus, by rotating a lever 300 of the female connector 200, the male connector 100 can be engaged with and disengaged from the female connector 200 at a low operating force. Incidentally, FIG. 1 shows a state where the male connector 100 is engaged with the female connector 200.

In the following description, the extension direction of the multi-core shield cables 105 and 205 is referred to as "longitudinal direction" of the shield connector 1 (male connector 100 and female connector 200). Particularly, in each of the male connector 100 and the female connector 200, engagement side of the male connector 100 (or the female connector 200) with the female connector 200 (or the male connector 100) is referred to as "front side" and disengagement side of the opposite to the front side (connection side of the male connector 100 with the multi-core shield cable 105, or connection side of the female connector 200 with the multi-core shield cable 205) is referred to as "rear side".

Figure 2A:
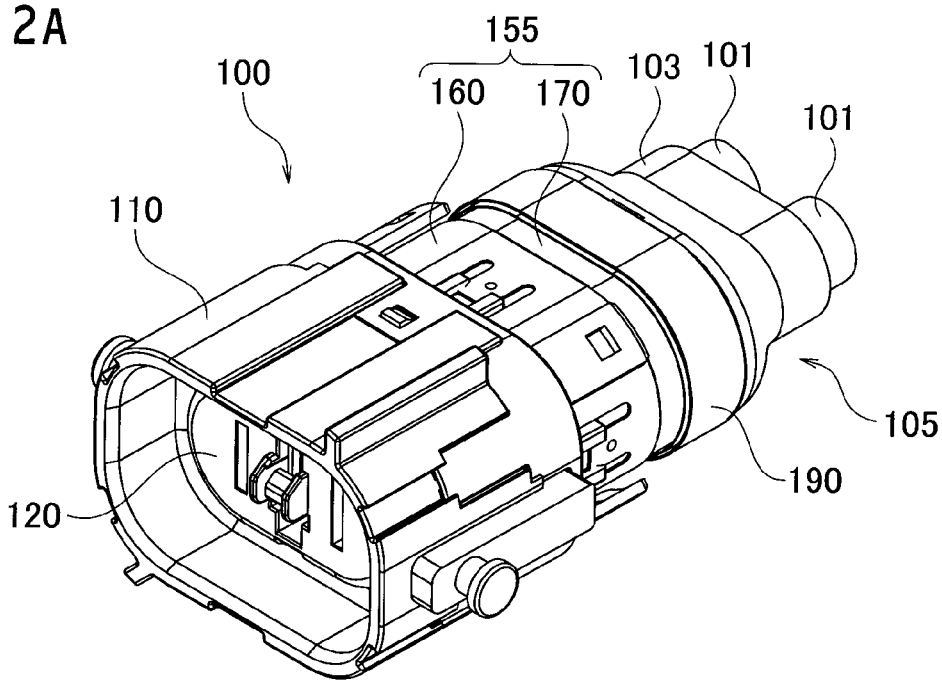
FIG. 2A is a perspective view of a male connector according to the exemplary embodiment of the present invention viewed from an insertion side.
Figure 2B:
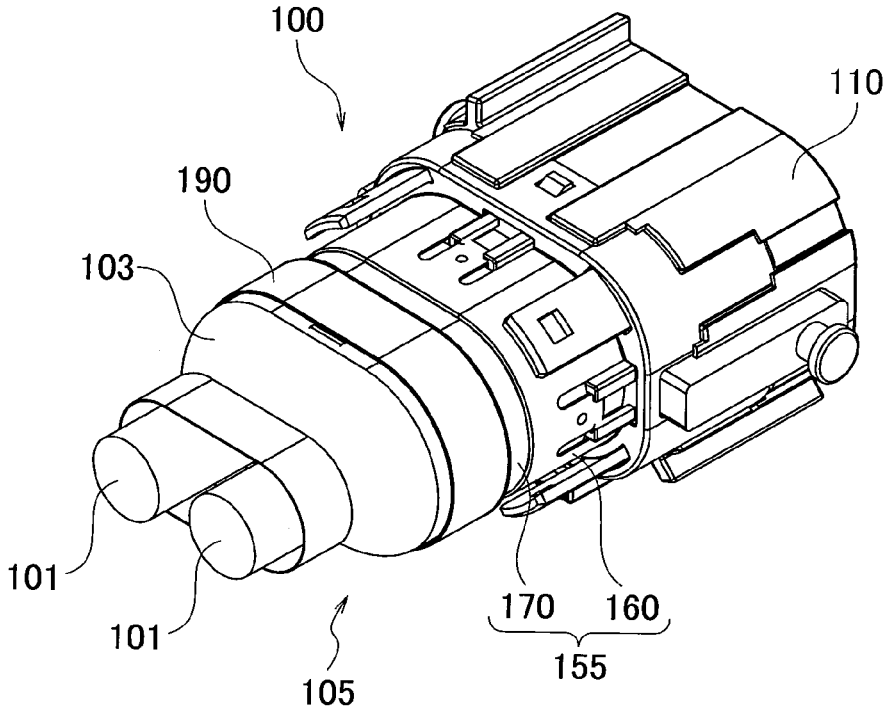
FIG. 2B is a perspective view of the male connector according to the exemplary embodiment of the present invention viewed from a connection side.

FIGS. 2A and 2B are perspective views of the male connector 100 viewed from the insertion side (front side) and the connection side (rear side). As shown in FIGS. 2A and 2B, the male connector has a male housing 110 (second housing) formed from insulating resin and a conductive shell 155. The shell 155 is connected with a braided wire 103 covering two electric cables 101 and 101 of the multi-core shield cable 105, which will be described later.

Figure 3:
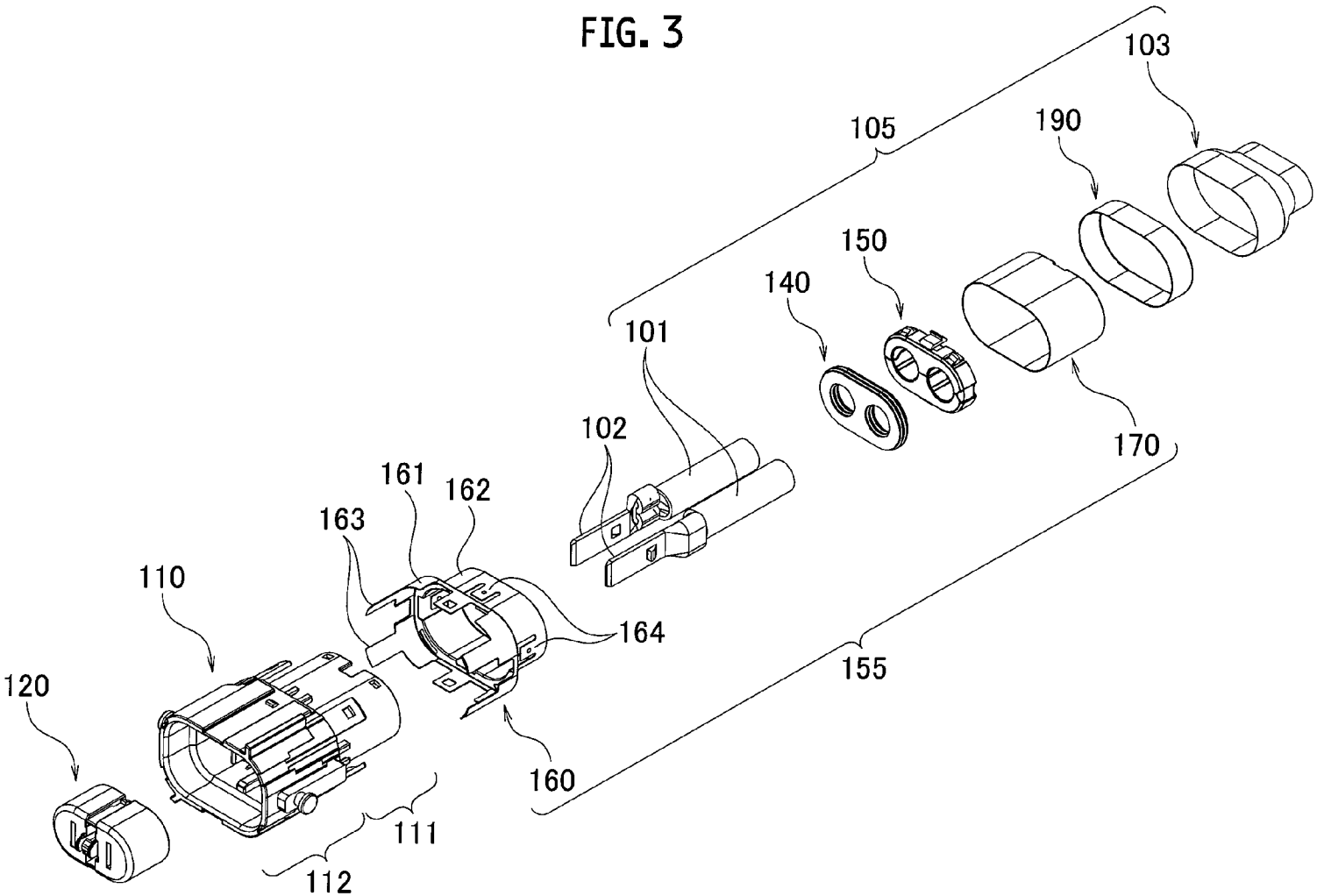
FIG. 3 is an exploded perspective view of the male connector in FIG. 2A.

As shown in FIG. 3, the male housing 110 has a double structure constituted by an inner housing 111 and an outer housing 112, which are of a tubular shape. Male terminals 102 and 102 (second terminal) respectively connected to the electric cables 101 and 101 are inserted into the inner housing 111 from the rear side.

The male terminals 102 and 102 are prevented from being exposed from an opening formed in the male housing 110 under a disengagement state from the female connector 200 by a moving plate 120 moving in the longitudinal direction inside the inner housing 111. The moving plate 120 relieves movement regulation against the inner housing 111 during engagement of the male connector 100 with the female connector 200 and moves backward. Thus, the male terminals 102 and 102 are exposed from the opening formed in the male housing 110 and are connectable with the female terminals 202 and 202 (refer to FIG. 5) on the female connector 200 side.

In the present embodiment, the conductive shell 155 is formed from two members: a shell body 160 and a braided wire fixing member 170. The shell body 160 is formed into a stepped shape constituted by a front side large-diameter section 161 and a rear side small-diameter section 162. The large-diameter section 161 is inserted into a clearance between the inner housing 111 and the outer housing 112 of the male housing 110. The small-diameter section 162 covers a rear side portion of the inner housing 111. The large-diameter section 161 has a plurality of terminal sections 163. Each of the terminal sections 163 comes into contact with a shell 255 (refer to FIG. 5) on the female connector 200 side when the male connector 100 is engaged with the female connector 200.

The braided wire fixing member 170 has a tubular shape to be engageable with the inner periphery of the small-diameter section 162 of the shell body 160. When the braided wire fixing member 170 is engaged with the inner periphery of the small-diameter section 162, a plurality of spring contacts 164 of the small-diameter section 162 comes into spring contact with the outer-periphery surface of the braided wire fixing member 170. The braided wire 103 of the multi-core shield cable 105 is swaged and fixed on the outer-periphery surface of the braided wire fixing member 170 by a braided wire swaging member 190.

A rubber plug 140 and a rear holder 150 are stored in the braided wire fixing member 170. The rear holder 150 locates the electric cables 101 and 101 at positions corresponding to an interval of the male terminals 102 and 102 inside the braided wire fixing member 170. The rubber plug 140 fills in a clearance between the braided wire fixing member 170 and the electric cables 101 and 101 to provide a watertight seal for the inside of the male housing 110.

Figure 4A:
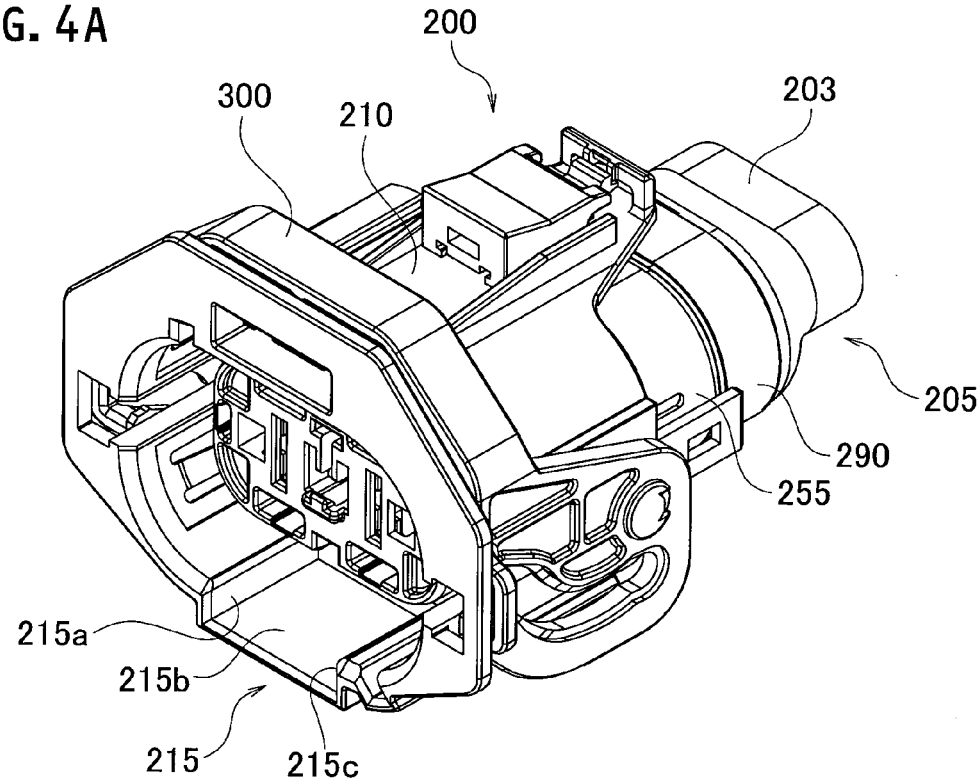
FIG. 4A is a perspective view of a female connector according to the exemplary embodiment of the present invention viewed from an insertion side.
Figure 4B:
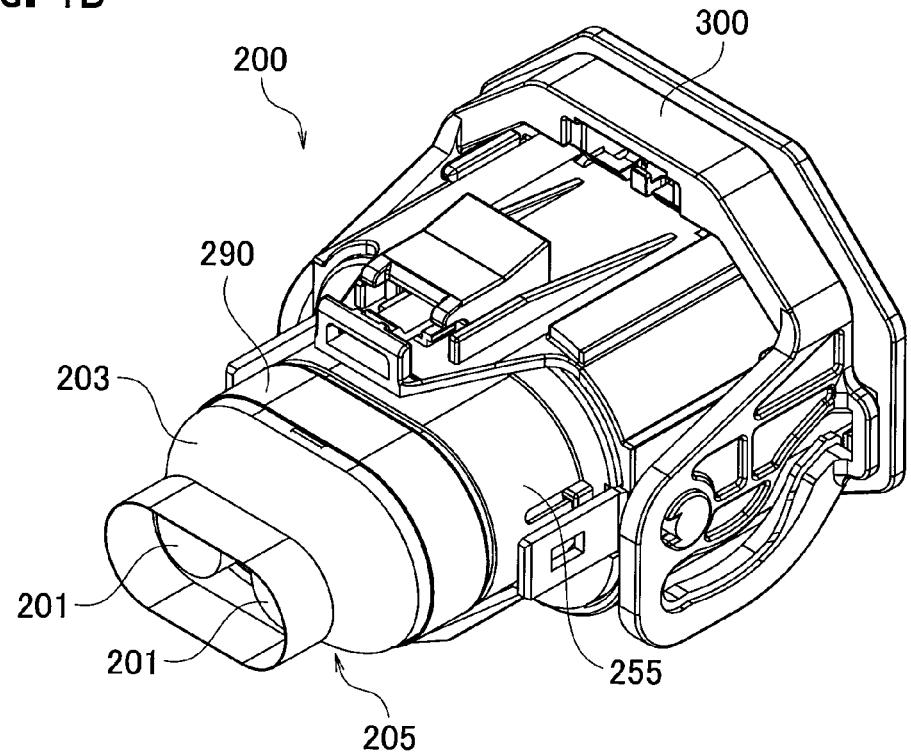
FIG. 4B is a perspective view of the female connector according to the exemplary embodiment of the present invention viewed from a connection side.

FIGS. 4A and 4B are perspective views of the female connector 200 viewed from the insertion side (front side) and the connection side (rear side). As shown in FIGS. 4A and 4B, the female connector 200 has a female housing 210 (first housing) formed from insulating resin and a conductive shell 255. The shell 255 is connected with a braided wire 203 covering two electric cables 201 and 201 of the multi-core shield cable 205, which will be described later.

Figure 5:
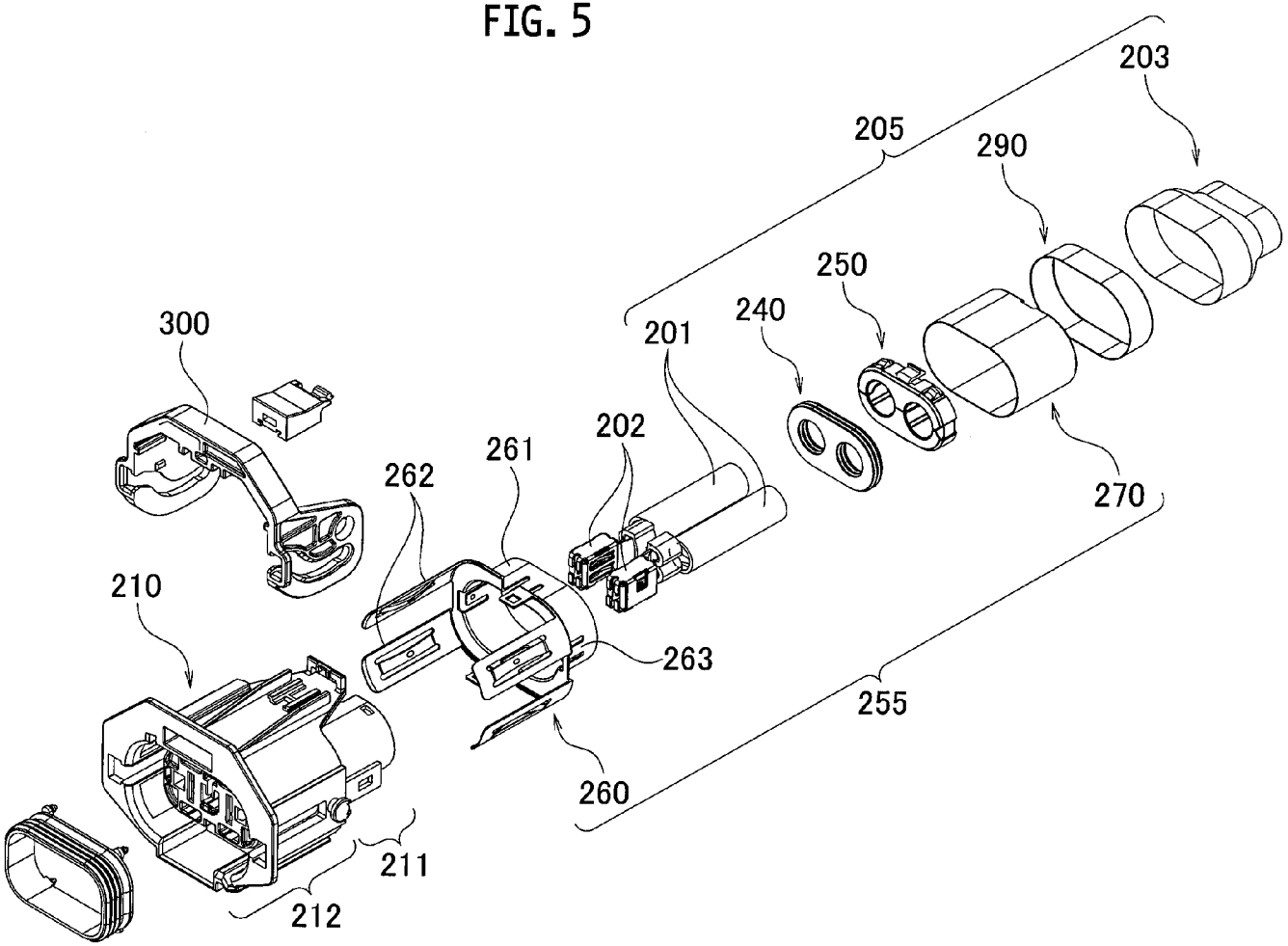
FIG. 5 is an exploded perspective view of the male connector in FIG. 4A.

As shown in FIG. 5, the female housing 210 has a double structure constituted by an inner housing 211 and an outer housing 212, which are of a tubular shape. Female terminals 202 and 202 (first terminal) respectively connected to the electric cables 201 and 201 are inserted into the inner housing 211 from the rear side. These female terminals 202 and 202 are exposed from the opening formed in the female housing 210, and when the male connector 100 is engaged with the female connector 200, the female terminals 202 and 202 are connected with the male terminals 102 and 102 (refer to FIG. 3) on the male connector 100 side.

In the present embodiment, the conductive shell 255 is formed from two members: a shell body 260 and a braided wire fixing member 270. The shell body 260 is formed into a stepped shape constituted by a rear side tubular section 261 and a plurality of terminal pieces 262 extending from the tubular section 261 in an L-letter shape. Each of the terminal pieces 262 is inserted into a clearance between the inner housing 211 and the outer housing 212 of the female housing 210 and exposed inside the female housing 210. The tubular section 261 covers a rear side portion of the inner housing 211. Each of the terminal pieces 262 comes into contact with a shell 155 (refer to FIG. 3) on the male connector 100 side when the male connector 100 is engaged with the female connector 200.

The braided wire fixing member 270 has a tubular shape to be engageable with the inner periphery of the tubular section 261 of the shell body 260. When the braided wire fixing member 270 is engaged with the inner periphery of the tubular section 261, a plurality of spring contacts 263 of the tubular section 261 comes into spring contact with the outer-periphery surface of the braided wire fixing member 270. The braided wire 203 of the multi-core shield cable 205 is swaged and fixed on the outer-periphery surface of the braided wire fixing member 270 by a braided wire swaging member 290.

A rubber plug 240 and a rear holder 250 are stored in the braided wire fixing member 270. The rear holder 250 locates the electric cables 201 and 201 at positions corresponding to an interval of the female terminals 202 and 202 inside the braided wire fixing member 270. The rubber plug 240 fills in a clearance between the braided wire fixing member 270 and the electric cables 201 and 201 to provide a watertight seal for the inside of the female housing 210.

Figure 6A:
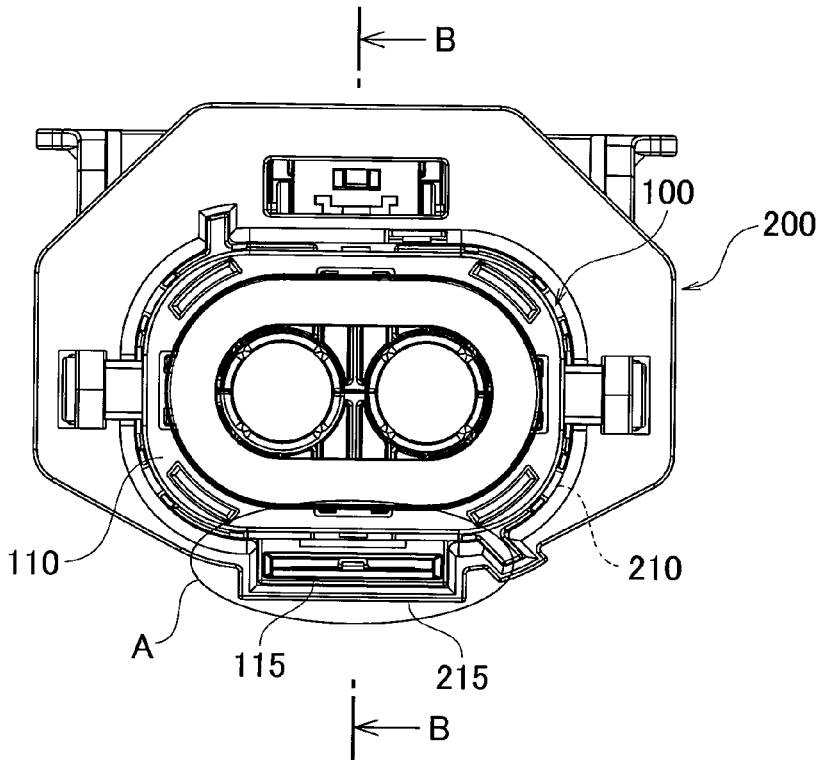
FIG. 6A is a descriptive view of the shield connector according to the exemplary embodiment of the present invention viewed from a male connector side.
Figure 6B:
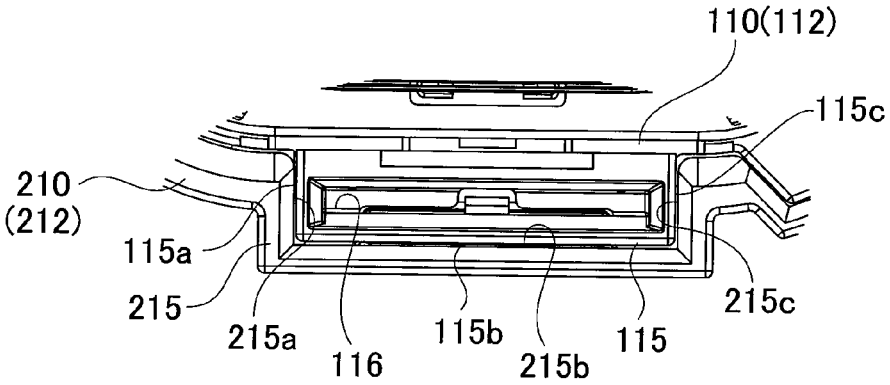
FIG. 6B is an enlarged descriptive view of a section "A" in FIG. 6A.
Figure 7A:
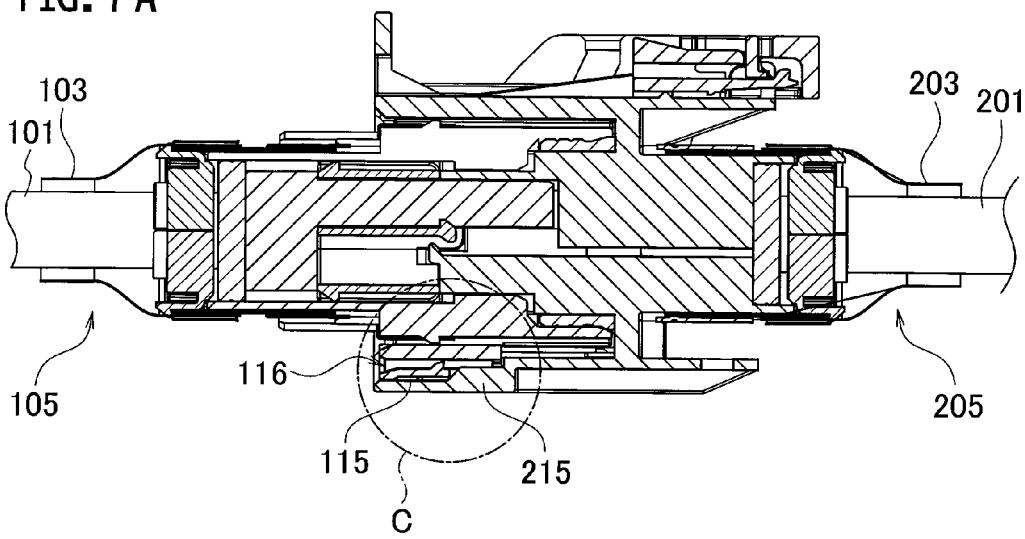
FIG. 7A is a sectional view taken on line B-B in FIG. 6A.

As shown in FIG. 6A, the male connector 100 has a cassette type insertion section 115 on the bottom face of the male housing 110. The cassette type insertion section 115, as shown in FIG. 6B, has a bracket insertion opening 116 opened on the rear side of the male connector 100. As shown in FIG. 7A, the cassette type insertion section 115 extends by a fixed length in the longitudinal direction of the male connector 100, that is, in an insertion direction of the male housing 110 into the female housing 210.

Figure 7B:
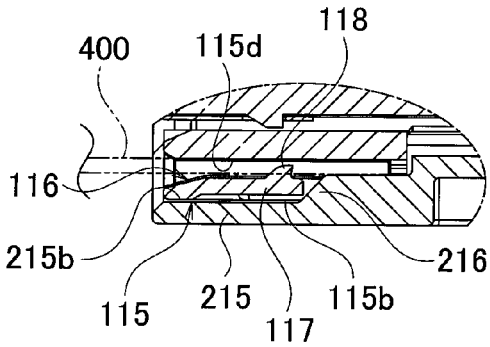
FIG. 7B is an enlarged sectional view of a section "C" in FIG. 7A.

As shown in FIG. 7B, an end of a fixing bracket 400 (to be described later) is inserted into a bracket insertion opening 116 formed in the cassette type insertion section 115 under a state where the end of the fixing bracket 400 faces the front side of the male connector 100. A proximal portion (not shown) of the fixing bracket 400 is fixed on a vehicle (not shown) at which the shield connector 1 is disposed. Accordingly, the male connector 100 is supported on the fixing bracket 400 inserted into the bracket insertion opening 116 formed in the cassette type insertion section 115 and is fixed at an inner position of the vehicle on which the shield connector 1 is disposed.

As shown in FIG. 6B, the cassette type insertion section 115 has three outer faces: side face 115*a*, bottom face 115*b*, side face 115*c* extending in the longitudinal direction of the male connector 100, that is, the insertion direction of the male housing 110 into the female housing 210.

As shown in FIG. 7B, the bottom face 115*b* of the cassette type insertion section 115 is partially omitted on the rear side of the male connector 100, thereby the dimension of the male connector 100 in the longitudinal direction is formed to be shorter than the overall length. On the bottom face 115*b*, there is formed a pressure piece 117 brought into spring contact with the fixing bracket 400 inserted from the bracket insertion opening 116. The pressure piece 117 has a locking piece 118. The locking piece 118 is locked at a locking hole (not shown) formed in the fixing bracket 400 to prevent the fixing bracket 400 from dropping off the bracket insertion opening 116.

At an opening formed in the female housing 210, a hood 215 is formed to meet the cassette type insertion section 115 of the male housing 110, as shown in FIG. 4A. As shown in FIG. 6B, the hood 215 has inner faces 215*a*, 215*b* and 215*c*, coming into face contact with the side face 115*a*, the bottom face 115*b* and the side face 115*c* of the cassette type insertion section 115 respectively, with the male connector 100 engaged with the female connector 200. As shown in FIG. 7B, a tapered surface 216 (pressure section) is formed inside the hood 215. The tapered surface 216 brings the end portion of the fixing bracket 400 exposed from the bottom face 115*b* of the cassette type insertion section 115 into pressure contact with a roof surface 115*d* of the cassette type insertion section 115. The pressure contact prevents looseness of the fixing bracket 400 in the cassette type insertion section 115.

The shield connector 1 structured in this way according to the present embodiment extends the fixing bracket 400 inserted into the cassette type insertion section 115 of the male housing 110 to the outside from an opening formed in the hood 215 of the female housing 210, under a state where the male connector 100 is engaged with the female connector 200. Therefore, the cassette type insertion section 115 has the bracket insertion opening 116, which is formed in an end face on the opposite side to the opening side of the hood 215 in the insertion direction of the male housing 110 into the female housing 210. In addition, the side face 115*a*, the bottom face 115*b* and the side face 115*c* of the cassette type insertion section 115 are extended in the insertion direction of the male housing 110 into the female housing 210.

Accordingly, when the male connector 100 is engaged with the female connector 200, a face contact portion with a fixed length in the insertion direction of the male housing 110 into the female housing 210 occurs between the hood 215 of the female housing 210 and the cassette type insertion section 115 of the male housing 110. Thus, a tight and sufficient coupling force can be ensured without looseness between the female connector 200 and the male connector 100 in each direction within a plane intersecting with the insertion direction of the male housing 110 into the female housing 210, in other words, each direction within a plane intersecting with the engagement direction of the male connector 100 with the female connector 200.

Note that, in the present embodiment, the tapered surface 216 formed on the hood 215 may be omitted. However, by forming the tapered surface 216 on the hood 215 and bringing a tip end of the fixing bracket 400 exposed from the bottom face 115*b* of the cassette type insertion section 115 into pressure contact with the roof surface 115*d* of the cassette type insertion section 115, looseness is eliminated between the cassette type insertion section 115 and the fixing bracket 400. Thus, in each direction within a plane intersecting with the engagement direction of the male connector 100 with the female connector 200, a tight and sufficient coupling force can be achieved without looseness between the cassette type insertion section 115 and the fixing bracket 400.

Furthermore, the present embodiment describes an example of a low insertion force connector (LIF connector) that engages/disengages the male connector 100 with/from the female connector 200 by rotating the lever 300, but the present invention is applicable to connectors of other types than the low insertion force connector (LIF connector).

In addition, in the present embodiment, the shells 155 and 255 of the male connector 100 and the female connector 200 are formed from two components: the shell bodies 160 and 260 and the braided wire fixing members 170 and 270, but the present invention is also applicable to the shield connector 1 with the shells 155 and 255 formed from a single component. In addition, the present embodiment describes an example of the shield connector 1 with high-voltage specification, but the present invention is also applicable to connectors with low-voltage specification.

The present invention is very useful in applying to a connector assembly structured to connect both terminals in respective housings with each other by inserting a second housing of a second connector into a first housing of a first connector to engage with both thereof.

What is claimed is:

1. A connector assembly comprising:

a first connector with a first housing storing a first terminal thereof; and a second connector engaging with the first connector by inserting a second housing thereof into the first housing such that a second terminal stored in the second housing is connected to the first terminal, wherein:

the second connector is mounted on a fixing bracket by inserting the fixing bracket into a cassette type insertion section formed on a face of the second housing, the first housing has a hood allowing the cassette type insertion section to be inserted from an insertion direction of the second housing by inserting the second housing mounted on the fixing bracket into the first housing, in a state where the second connector is engaged with the first connector, an outer face of the cassette type insertion section extending in the insertion direction of the second housing into the first housing comes into face contact with an inner face provided in the hood, and the fixing bracket extends from an opening formed in the hood to the outside of the hood, and the hood has a pressure section therein that is brought into contact with the fixing bracket inserted into the cassette type insertion section in a state where the second connector is engaged with the first connector, thereby bringing the fixing bracket into pressure contact with an inner face of the cassette type insertion section.

2. The connector assembly according to claim 1, further comprising a lever mounted on the first connector and structured to engage or disengage the second connector with or from the first connector by rotating the lever, wherein the cassette type insertion section is inserted into the hood as the second housing is inserted into the first housing by rotating the lever.

* * * * *